US006517414B1

(12) United States Patent
Tobin et al.

(10) Patent No.: US 6,517,414 B1
(45) Date of Patent: Feb. 11, 2003

(54) METHOD AND APPARATUS FOR CONTROLLING A PAD CONDITIONING PROCESS OF A CHEMICAL-MECHANICAL POLISHING APPARATUS

(75) Inventors: James F. Tobin, Fremont, CA (US); Greg Weise, Campbell, CA (US)

(73) Assignee: Appied Materials, Inc., Santa Clara, CA (US)

( * ) Notice: Subject to any disclaimer, the term of this patent is extended or adjusted under 35 U.S.C. 154(b) by 0 days.

(21) Appl. No.: 09/523,368

(22) Filed: Mar. 10, 2000

(51) Int. Cl.[7] ..... B24B 49/00

(52) U.S. Cl. ..... 451/8; 451/21; 451/56; 451/72; 451/443

(58) Field of Search ..... 451/8, 9, 21, 56, 451/443, 72

(56) References Cited

U.S. PATENT DOCUMENTS

| | | | | |
|---|---|---|---|---|
| 5,014,468 A | | 5/1991 | Ravipati et al. | 51/295 |
| 5,437,754 A | | 8/1995 | Calhoun | 156/231 |
| 5,453,312 A | | 9/1995 | Haas et al. | 428/143 |
| 5,454,844 A | | 10/1995 | Hibbard et al. | 51/295 |
| 5,456,627 A | | 10/1995 | Jackson et al. | 451/11 |
| 5,472,371 A | | 12/1995 | Yamakura et al. | 451/56 |
| 5,516,400 A | | 5/1996 | Pasch et al. | 156/636.1 |
| 5,569,062 A | | 10/1996 | Karlsrud | 451/285 |
| 5,584,789 A | | 12/1996 | Mitsuhashi et al. | 451/285 |
| 5,618,447 A | | 4/1997 | Sandhu | 438/14 |
| 5,655,951 A | | 8/1997 | Meikle et al. | 451/56 |
| 5,725,417 A | | 3/1998 | Robinson | 451/56 |
| 5,738,574 A | | 4/1998 | Tolles et al. | 451/288 |
| 5,743,784 A | * | 4/1998 | Birang et al. | |
| 5,779,521 A | | 7/1998 | Muroyama et al. | 451/56 |
| 5,804,507 A | | 9/1998 | Perlov et al. | 438/692 |
| 5,833,519 A | | 11/1998 | Moore | 451/56 |
| 5,842,912 A | | 12/1998 | Holzapfel et al. | 451/72 |
| 5,857,899 A | | 1/1999 | Volodarsky et al. | 451/72 |
| 5,875,559 A | | 3/1999 | Birang et al. | 33/553 |
| 5,879,222 A | | 3/1999 | Robinson | 451/41 |
| 5,879,226 A | | 3/1999 | Robinson | 451/287 |
| 5,899,800 A | | 5/1999 | Shendon | 451/287 |
| 5,906,754 A | | 5/1999 | Appel et al. | 216/88 |
| 5,908,530 A | | 6/1999 | Hoshizaki et al. | 156/345 |

(List continued on next page.)

FOREIGN PATENT DOCUMENTS

| | | | |
|---|---|---|---|
| EP | 0 517 594 | 12/1992 | B24B/37/04 |
| EP | 0 696 495 | 2/1996 | B24B/37/04 |
| WO | WO 93/02837 | 2/1993 | B24D/3/00 |
| WO | WO 98/45090 | 10/1998 | B24B/53/10 |

OTHER PUBLICATIONS

U.S. patent application Ser. No. 09/676,280, Li et al., filed Sep. 28, 2000.

PCT International Search Report from PCT/US 01/04359, Dated Jun. 7, 2001.

*Primary Examiner*—Joseph J. Hail, III
*Assistant Examiner*—Willie Berry, Jr.
(74) *Attorney, Agent, or Firm*—Moser, Patterson and Sheridan

(57) ABSTRACT

A method and apparatus for improving the pad conditioning process of a polishing pad in a chemical-mechanical polishing apparatus employs closed loop control of the polishing pad conditioning process. An arrangement includes a pad conditioning head carried by an arm that is coupled to an arm support located remotely from the conditioning head. A down force sensor in the arm support measures the down force exerted by the pad conditioning head through the conditioning disk. A controller receives the down force measurements from the down force sensor and controls the arm support to controllably vary the down force exerted by the pad conditioning head. The conditioning apparatus is thus controlled in response to the feedback from the down force measurements in a closed loop control to modify the conditioning process and control the pad wear uniformity.

13 Claims, 11 Drawing Sheets

U.S. PATENT DOCUMENTS

| | | | | | |
|---|---|---|---|---|---|
| 5,916,012 | A | | 6/1999 | Pant et al. | 451/41 |
| 5,941,762 | A | | 8/1999 | Ravkin et al. | 451/56 |
| 5,951,370 | A | * | 9/1999 | Cesna | |
| 5,961,372 | A | | 10/1999 | Shendon | 451/41 |
| 5,975,994 | A | * | 11/1999 | Sandhu et al. | |
| 5,990,010 | A | | 11/1999 | Berman | 438/691 |
| 6,004,196 | A | | 12/1999 | Doan et al. | 451/443 |
| 6,019,670 | A | | 2/2000 | Cheng et al. | 451/56 |
| 6,080,046 | A | | 6/2000 | Shendon et al. | 451/54 |
| 6,086,457 | A | | 7/2000 | Perlov et al. | 451/41 |
| 6,123,607 | A | * | 9/2000 | Ravkin et al. | |
| 6,126,517 | A | | 10/2000 | Tolles et al. | 451/41 |
| 6,186,864 | B1 | * | 2/2001 | Fisher et al. | |
| 6,190,236 | B1 | | 2/2001 | Drill | 451/41 |
| 6,193,587 | B1 | | 2/2001 | Lin et al. | 451/56 |
| 6,196,899 | B1 | | 3/2001 | Chopra et al. | 451/56 |
| 6,213,856 | B1 | | 4/2001 | Cho et al. | 451/443 |
| 6,244,935 | B1 | | 6/2001 | Birang et al. | 451/41 |
| 6,276,996 | B1 | | 8/2001 | Chopra | 451/41 |
| 6,306,008 | B1 | * | 10/2001 | Moore | |

* cited by examiner

METHOD AND APPARATUS FOR CONTROLLING A PAD CONDITIONING PROCESS OF A CHEMICAL-MECHANICAL POLISHING APPARATUS

FIELD OF THE INVENTION

The invention relates to chemical mechanical polishing of substrates, and more particularly to an apparatus for optimizing a polishing pad conditioning process.

BACKGROUND ART

Integrated circuits are typically formed on substrates, particularly silicon wafers, by the sequential deposition of conductive, semiconductive or insulative layers. After each layer is deposited, the layer is etched to create circuitry features. As a series of layers are sequentially deposited and etched, the outer or uppermost surface of the substrate, i.e., the exposed surface of the substrate, becomes successively more non-planar. This occurs because the distance between the outer surface and the underlying substrate is greatest in regions of the substrate where the least etching has occurred, and least in regions where the greatest etching has occurred. Within a single patterned underlying layer, this non-planar surface comprises a series of peaks and valleys wherein the distance between the highest peak and the lowest valley may be on the order of 7000 to 10,000 Angstroms. With multiple patterned underlying layers, the height difference between the peaks and valleys becomes even more severe, and can reach several microns.

This non-planar outer surface presents a problem for the integrated circuit manufacturer. If the outer surface is non-planar, then photolithographic techniques to pattern photoresist layers might not be suitable, as a non-planar surface can prevent proper focusing of the photolithography apparatus. Therefore, there is a need to periodically planarize this substrate surface to provide a planar layer surface. Planarization, in effect, polishes away a non-planar, outer surface, whether a conductive, semiconductive, or insulative layer, to form a relatively flat, smooth surface. Following planarization, additional layers may be deposited on the outer layer to form interconnect lines between features, or the outer layer may be etched to form vias to lower features.

Chemical mechanical polishing is one accepted method of planarization. This planarization method typically requires that the substrate be mounted on a carrier or polishing head, with the surface of the substrate to be polished exposed. The substrate is then placed against a rotating polishing pad. In addition, the carrier head may rotate to provide additional motion between the substrate and polishing surface. Further, a polishing slurry, including an abrasive and at least one chemically-reactive agent, may be spread on the polishing pad to provide an abrasive chemical solution at the interface between the pad and substrate.

Important factors in the chemical mechanical polishing process are: the finish (roughness) and flatness (lack of large scale topography) of the substrate surface, and the polishing rate. Inadequate flatness and finish can produce substrate defects. The polishing rate sets the time needed to polish a layer. Thus, it sets the maximum throughput of the polishing apparatus.

Each polishing pad provides a surface which, in combination with the specific slurry mixture, can provide specific polishing characteristics. Thus, for any material being polished, the pad and slurry combination is theoretically capable of providing a specified finish and flatness on the polished surface. The pad and slurry combination can provide this finish and flatness in a specified polishing time. Additional factors, such as the relative speed between the substrate and pad, and the force pressing the substrate against the pad, affect the polishing rate, finish and flatness.

Because inadequate flatness and finish can create defective substrates, the selection of a polishing pad and slurry combination is usually dictated by the required finish and flatness. Given these constraints, the polishing time needed to achieve the required finish and flatness sets the maximum throughput of the polishing apparatus.

An additional limitation on polishing throughput is "glazing" of the polishing pad. Glazing occurs when the polishing pad is heated and compressed in regions where the substrate is pressed against it. The peaks of the polishing pad are pressed down and the pits of the polishing pad are filled up, so the surface of the polishing pad becomes smoother and less abrasive. As a result, the polishing time required to polish a substrate increases. Therefore, the polishing pad surface must be periodically returned to an abrasive condition, or "conditioned", to maintain a high throughput.

Another consideration in the production of integrated circuits is process and product stability. To achieve a low defect rate, each successive substrate should be polished under similar conditions. Each substrate should be polished by approximately the same amount so that each integrated circuit is substantially identical.

An apparatus for measuring the profile of a polishing pad in a chemical-mechanical polishing system has been described in U.S. Pat. No. 5,875,559. The apparatus generates pad profiles that include the measurement of the thickness of the polishing pad which may be used to optimize the polishing process parameters or to select a conditioning process. The pad profiler generates plots of the surface profile of the polishing pad. These plots may be used by machine operators to select a conditioning process. There is no automatic control or closed loop control of the conditioning process. Hence, if any changes need to be made to the conditioning process based on the surface profiles generated by the pad profiler, these changes would be made in a separate operation by the machine operator.

Another apparatus for measuring the profile of a pad has been discussed in U.S. Pat. No. 5,618,447. In an unshown embodiment, a processor is described as being operatively coupled to a pad conditioning device. The processor selectively controls the pad conditioning device according to the contour measurements from the sensor to change the contour of the polishing surface of the pad. After the pad has been selectively conditioned, the contour of the new polishing surface is preferably re-measured to determine whether the new polishing surface has the desired post-conditioning contour.

One of the drawbacks to the process discussed in U.S. Pat. No. 5,618,447 is that the measurement of the pad profile is not preformed in-situ such that the pad conditioning process can be changed during the conditioning process. It is only after the conditioning process is complete that a remeasurement of the pad profile is performed. Hence, since there is no immediate feedback and closed loop control of the conditioning process, it is possible for the pad to be improperly conditioned at any given time.

In view of the foregoing, there is a need for a chemical-mechanical polishing apparatus that provides precise and immediate control of the pad conditioning process.

SUMMARY OF THE INVENTION

There is a need for a method and apparatus to control a pad conditioning process automatically in a manner that provides precise and immediate control of the pad conditioning process.

These and other needs are met by embodiments of the present invention which provide an arrangement for conditioning a polishing pad of a chemical-mechanical polishing apparatus. The arrangement includes a pad conditioning head and a disk carrier on the pad conditioning head. The disk carrier is configured to receive and carry a polishing pad conditioning disk. The arrangement includes an arm having first and second distal ends, the pad conditioning head being coupled to the first distal end. An arm support is coupled to the second distal end of the arm. The arm support is configured to move the arm to position a conditioning disk carried by the disk carrier against a polishing pad with a controlled amount of down force against the polishing pad. A down force sensor measures the down force exerted by the pad conditioning head through a conditioning disk against a polishing pad. A controller receives the down force measurements from the down force sensor and controls the arm support to controllably vary the down force exerted by the pad conditioning head.

By providing an arm support that is configured to move an arm to position a conditioning disk against a polishing pad with a controlled amount of down force, the present invention provides a precise and in situ arrangement for controlling the conditioning of the polishing pad. The use of the arm support to position the conditioning disk against the polishing pad and control the amount of down force through the arm support, allows the conditioning head to be simplified in construction as it does not require a disk carrier that moves vertically away from the arm support towards the polishing pad. Instead, the control of the down force is provided at the arm support. The disk carrier therefore only needs to make a rotary motion.

The earlier stated needs are also met by other embodiments of the present invention which provide a chemical-mechanical polishing apparatus comprising a platen for supporting a polishing pad, a wafer carrier for carrying a wafer and positioning the wafer against the polishing pad to polish the wafer, and a conditioning arrangement for conditioning a polishing pad. This conditioning arrangement includes a pad conditioning head, with a disk carrier on the pad conditioning head. The disk carrier is configured to receive and carry a polishing pad conditioning disk. The polishing pad conditioning arrangement also includes an arm having first and second distal ends, with the pad conditioning head being coupled to the first distal end. An arm support is coupled to the second distal end of the arm. The arm support is configured to move the arm to position a conditioning disk carried by the disk carrier against a polishing pad with a controlled amount of down force against the polishing pad. A down force sensor measures the down force exerted by the pad conditioning head through a conditioning disk against a polishing pad. A controller receives the down force measurements from the down force sensor and controls the arm support to controllably vary the down force exerted by the pad conditioning head.

The earlier stated needs are also met by another embodiment of the present invention which provides a method of conditioning a polishing pad of a chemical-mechanical polishing apparatus comprising the steps of determining a wear condition of a polishing pad and positioning a conditioning head over a polishing surface of the polishing pad through an arm arrangement that is connected to the apparatus and to the conditioning head. A conditioning disk carried by the conditioning head is positioned onto the polishing pad with a controlled down force of the conditioning disk against the polishing surface. The down force is measured with a sensor located in the arm arrangement and the polishing pad is conditioned. The down force of the conditioning disk is controlled during the conditioning of the polishing pad as a function of the determined wear condition of the polishing pad and the measured down force of the conditioning disk on the polishing pad.

The earlier stated needs and others are met by another embodiment of the present invention which provides an arrangement for conditioning a polishing pad of a chemical-mechanical polishing apparatus. This arrangement includes a pad conditioning head, a disk carrier on the pad conditioning head, the disk carrier being configured to receive and carry a polishing pad conditioning disk. An arm is provided having first and second distal ends, the pad conditioning head being coupled to the first distal end. An arm support is coupled to the second distal end of the arm. The arm support has a rotary actuator to rotate the arm to position a conditioning disk carried by the disk carrier over a polishing pad. The arm support also has a vertical actuator to move the arm in a direction normal to a polishing pad to position a polishing pad conditioning disk carried by the disk carrier against a polishing pad.

Additional advantages of the present invention will become readily apparent to those skilled in this art from the following detailed description, wherein embodiments of the present invention are described, simply by way of illustration of the best mode contemplated for carrying out the present invention. As will be realized, the present invention is capable of other and different embodiments, and its several details are capable of modifications in various obvious respects, all without departing from the present invention. Accordingly, the drawings and description are to be regarded as illustrative in nature, and not as restrictive.

DETAILED DESCRIPTION OF THE INVENTION

Figure 1A:
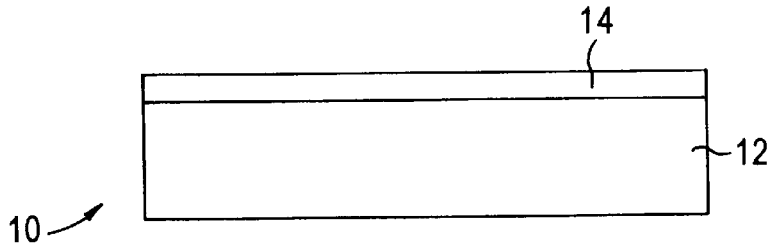
FIGS. 1A–1E are schematic diagrams illustrating the deposition and etching of a layer on a substrate.
Figure 1B:
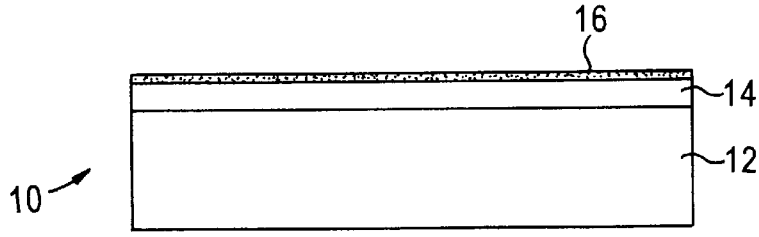
Figure 1C:
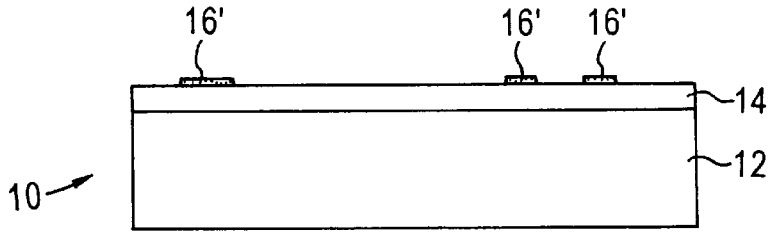
Figure 1D:
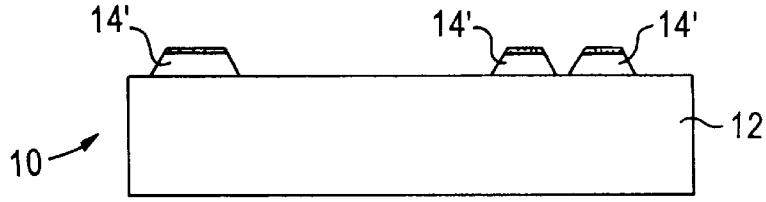
Figure 1E:
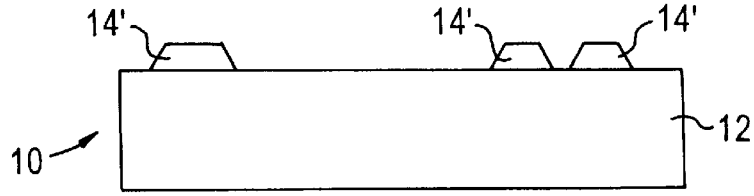

FIGS. 1A–E illustrate the process of depositing a layer onto a planar surface of a substrate. As shown in FIG. 1A, a substrate 10 might be processed by coating a flat semiconductive silicon wafer 12 with a metal layer 14, such as aluminum. Then, as shown in FIG. 1B, a layer of photoresist 16 may be placed on metal layer 14. Photoresist layer 16 can then be exposed to a light image, as discussed in more detail below, producing a patterned photoresist layer 16' shown in FIG. 1C. As shown in FIG. 1D, after patterned photoresist 5 layer 16' is created, the exposed portions of metal layer 14 are etched to create metal islands 14'. Finally, as shown in FIG. 1E, the remaining photoresist is removed.

Figure 2A:
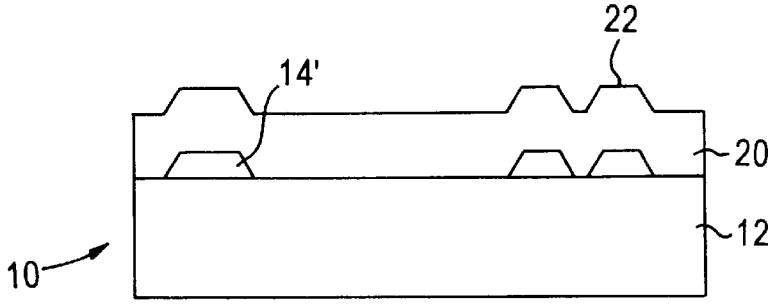
FIGS. 2A–2C are schematic diagrams illustrating the polishing of a non-planar outer surface of a substrate.
Figure 2B:
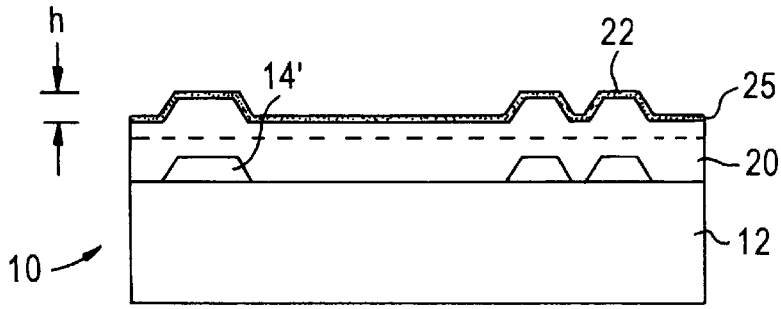

FIGS. 2A–2B illustrate the difficulty presented by deposition of subsequent layers on a substrate. As shown in FIG. 2A, an insulative layer 20, such as silicon dioxide, may be deposited over metal islands 14'. The outer surface 22 of insulative layer 20 almost exactly replicates the underlying structures of the metal islands, creating a series of peaks and valleys so outer surface 22 is non-planar. An even more complicated outer surface would be generated by depositing and etching multiple layers on an underlying patterned layer.

If, as shown in FIG. 2B, outer surface 22 of substrate 10 is non-planar, then a photoresist layer 25 placed thereon is also non-planar. A photoresist layer is typically patterned by a photolithographic apparatus that focuses a light image onto the photoresist. Such an imaging apparatus typically has a depth of focus of about 0.2 to 0.4 microns for sub-halfinicron feature sizes. If the photoresist layer 25 is sufficiently non-planar, that is, if the maximum height difference h between a peak and valley of outer surface 22 is greater than the depth of focus of the imaging apparatus, then it will be impossible to properly focus the light image onto the entire surface 22. Even if the imaging apparatus can accommodate the non-planarity created by a single underlying patterned layer, after the deposition of a sufficient number of patterned layers, the maximum height difference will exceed the depth of focus.

It may be prohibitively expensive to design new photolithographic devices having an improved depth of a focus. In addition, as the feature size used in integrated circuits becomes smaller, shorter wavelengths of light must be used, resulting in further reduction of the available depth of focus.

Figure 2C:
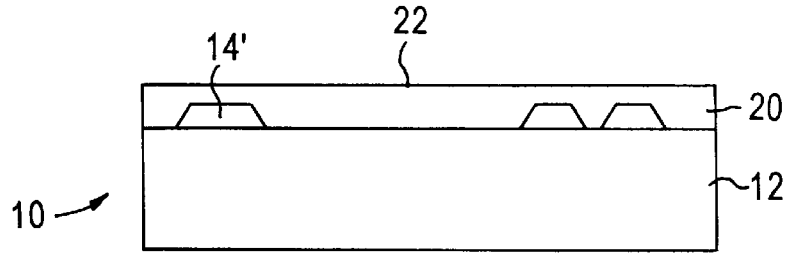

A solution, as shown in FIG. 2C, is to planarize the outer surface. Planarization wears away the outer surface, whether metal, semiconductive, or insulative, to form a substantially smooth, flat outer surface 22. As such, the photolithographic apparatus can then be properly focused. Planarization could be performed only when necessary to prevent the peak-to-valley difference from exceeding the depth of focus, or planarization could be performed each time a new layer is deposited over a patterned layer.

Polishing may be performed on metallic, semiconductive, or insulative layers. The particular reactive agents, abrasive particles, and catalysts will differ depending on the surface being polished. The present invention is applicable to polishing of any of the above layers.

Figure 3:
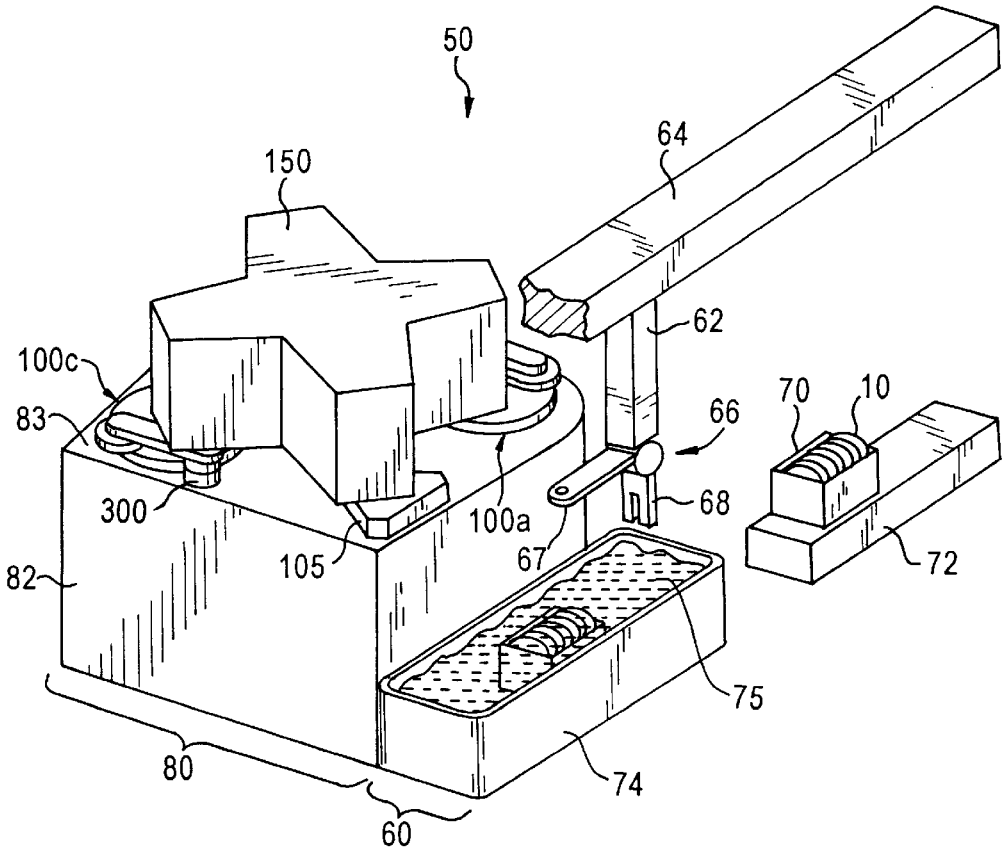
FIG. 3 is a schematic perspective view of a chemical-mechanical polishing apparatus.

As shown in FIG. 3, a chemical-mechanical polishing system according to the present invention includes a loading apparatus 60 adjacent to a polishing apparatus 80. Loading apparatus 60 includes a rotatable, extendable arm 62 hanging from an overhead track 64. In the figure, overhead track 64 has been partially cut-away to more clearly show polishing apparatus 80. Arm 62 ends in a wrist assembly 66 which includes a blade 67 with a vacuum port and a cassette claw 68.

Substrates 10 are brought to polishing system 50 in a cassette 70 and placed on a holding station 72 or directly into a tub 74. Cassette claw 68 on arm 64 may be used to grasp cassette 70 and move it from holding station 72 to tub 74. Tub 74 is filled with a liquid bath 75, such as deionized water. Blade 67 fastens to an individual substrate from cassette 70 in tub 74 by vacuum suction, removes the substrate from cassette 70, and loads the substrate into polishing apparatus 80. Once polishing apparatus 80 has completed polishing the substrate, blade 67 returns the substrate to the same cassette 70 or to a different one. Once all of the substrates in cassette 70 are polished, claw 68 may remove cassette 70 from tub 74 and return the cassette to holding station 72.

Figure 4:
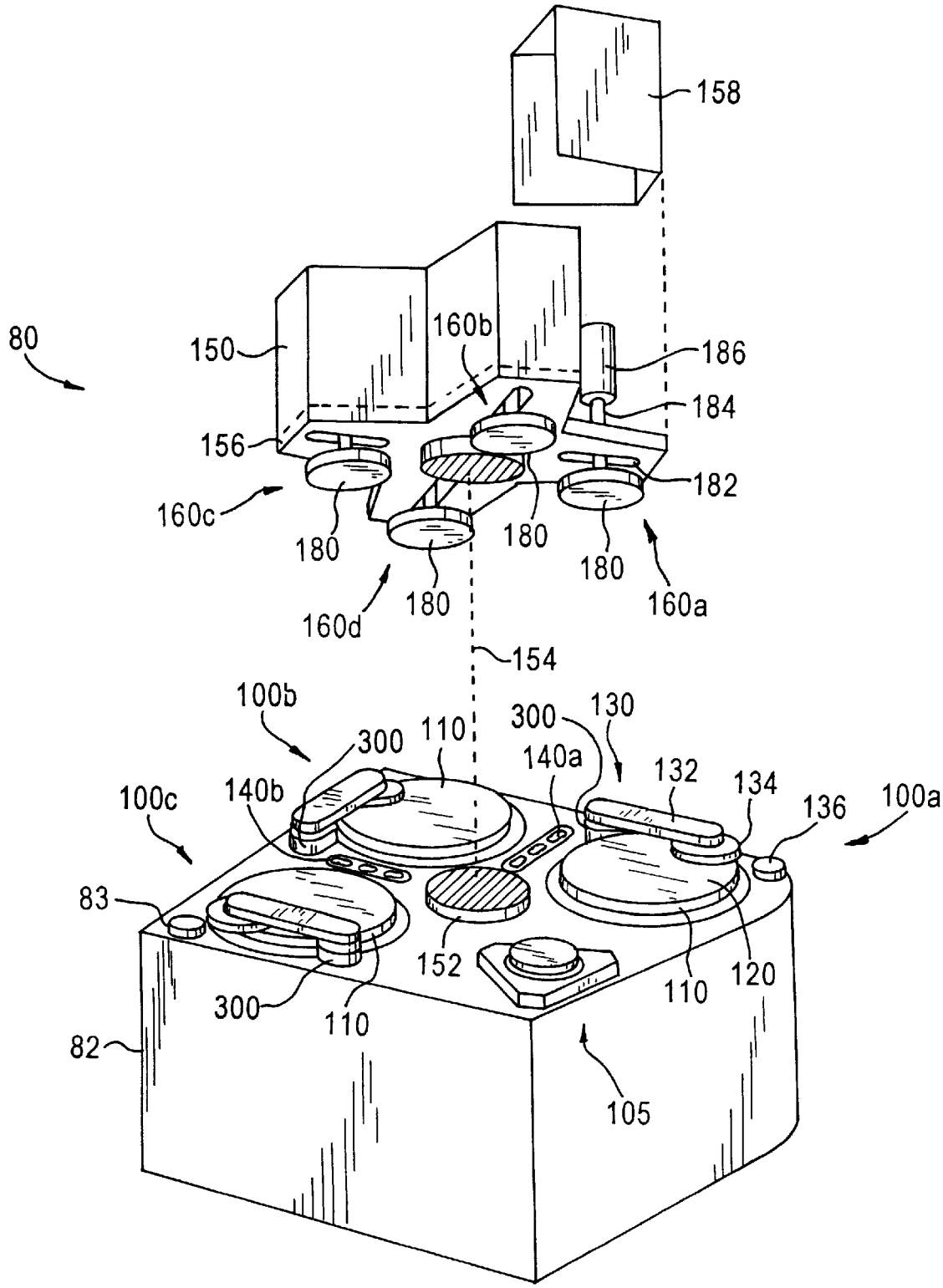
FIG. 4 is a schematic exploded perspective view of the chemical-mechanical polishing apparatus of FIG. 3.

Polishing apparatus 80 includes a lower machine base 82 with a table top 83 mounted thereon and removable upper outer cover (not shown). As best seen in FIG. 4, table top 83 supports a series of polishing stations 100*a,* 100*b* and 100*c,* and a transfer station 105. Transfer station 105 forms a generally square arrangement with the three polishing stations 100*a,* 100*b* and 100*c.* Transfer station 105 serves multiple functions of receiving individual substrates 10 from loading apparatus 60, washing the substrates, loading the substrates into carrier heads (to be described below), receiving the substrates from the carrier heads, washing the substrates again, and finally transferring the substrates back to loading apparatus 60 which returns the substrates to the cassette.

Each polishing station 100*a,* 100*b,* or 100*c* includes a rotatable platen 110 on which is placed a polishing pad 120. Each polishing station 100*a,* 100*b* and 100*c* may further include an associated pad conditioner apparatus 130. Each pad conditioner apparatus 130 has a rotatable arm 132 holding an independently rotating conditioner head 134 and an associated washing basin 136. The conditioner apparatus maintains the condition of the polishing pad so it will effectively polish any substrate pressed against it while it is rotating. Two or more intermediate washing stations 140*a* and 140*b* are positioned between neighboring polishing stations 100*a,* 100*b,* 100*c* and transfer station 105. The washing stations rinse the substrates as they pass from one polishing station to another.

A rotatable multi-head carousel 150 is positioned above lower machine base 82. Carousel 150 is supported by a center post 152 and rotated thereon about a carousel axis 154 by a carousel motor assembly located within base 82. Center post 152 supports a carousel support plate 156 and a cover 158.

Multi-head carousel 150 includes four carrier head systems 160*a,* 160*b,* 160*c,* and 160*d.* Three of the carrier head systems receive and hold a substrate, and polish it by pressing it against the polishing pad 120 on platen 110 of polishing stations 100*a,* 100*b* and 100*c.* One of the carrier head systems receives substrates from and delivers substrates to transfer station 105.

In the preferred embodiment, the four carrier head systems 160*a*–160*d* are mounted on carousel support plate 156 at equal angular intervals about carousel axis 154. Center post 152 supports carousel support plate 156 and allows the carousel motor to rotate the carousel support plate 156 and to orbit the carrier head systems 160*a*–160*d,* and the substrates attached thereto, about carousel axis 154.

Each carrier head system 160*a*–160*d* includes a polishing or carrier head ISO. Each carrier head ISO independently rotates about its own axis, and independently laterally oscillates in a radial slot 182 formed in support plate 156. A carrier drive shaft 184 connects a carrier head rotation motor 186 to carrier head 180 (shown by the removal of one-quarter of cover 158). There is one carrier drive shaft and motor for each head.

The substrates attached to the bottom of carrier heads 180 may be raised or lowered by the polishing head systems 160*a*–160*d*. An advantage of the overall carousel system is that only a short vertical stroke is required of the polishing head systems to accept substrates, and position them for polishing and washing. An input control signal (e.g., a pneumatic, hydraulic, or electrical signal), causes expansion or contraction of carrier head 180 of the polishing head systems in order to accommodate any required vertical stroke.

Specifically, the input control signal causes a lower carrier member having a wafer receiving recess to move vertically relative to a stationary upper carrier member. During actual polishing, three of the carrier heads, e.g., those of polishing head systems 160*a*–160*c*, are positioned at and above respective polishing stations 100*a*–100*c*. Each rotatable platen 110 supports a polishing pad 120 with a top surface which is wetted with an abrasive slurry. Carrier head 180 lowers a substrate to contact polishing pad 120, and the abrasive slurry acts as the media for both chemically and mechanically polishing the substrate or wafer.

After each substrate is polished, polishing pad 120 is conditioned by conditioning apparatus 130. Arm 132 sweeps conditioner head 134 across polishing pad 120 in an oscillatory motion generally between the center of polishing pad 120 and its perimeter. Conditioner head 134 includes an abrasive surface, such as a nickel-coated diamond surface. The abrasive surface of conditioner head 134 is pressed against rotating polishing pad 120 to abrade and condition the pad.

In use, the polishing head 180, for example, that of the fourth carrier head system 160*d*, is initially positioned above the wafer transfer station 105. When the carousel 150 is rotated, it positions different carrier head systems 160*a*, 160*b*, 160*c*, and 160*d* over the polishing stations 100*a*, 100*b* and 100*c*, and the transfer station 105. The carousel 150 allows each polishing head system to be sequentially located, first over the transfer station 105, and then over one or more of the polishing stations 100*a*–100*c*, and then back to the transfer station 105.

Figure 5A:
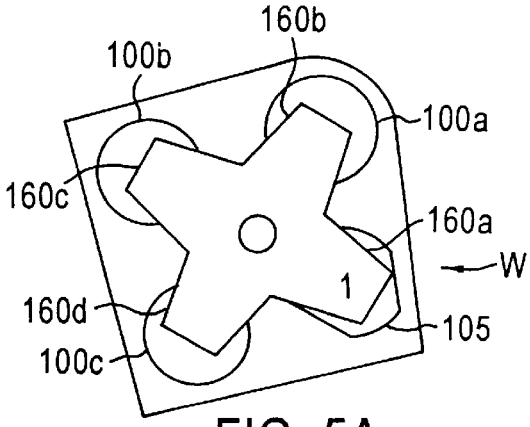
FIGS. 5A–5F are schematic top views of the polishing apparatus illustrating the progressive movements of wafers as they are sequentially loaded and polished.
Figure 5B:
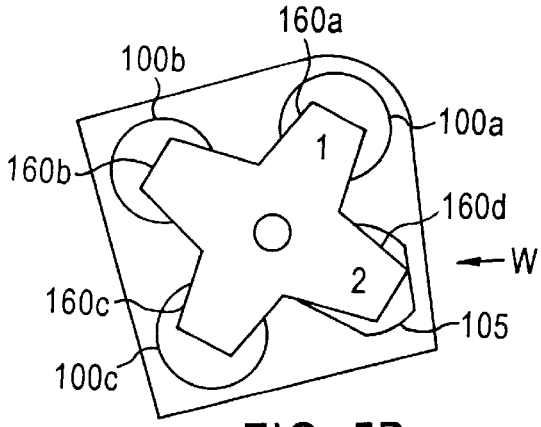
Figure 5C:
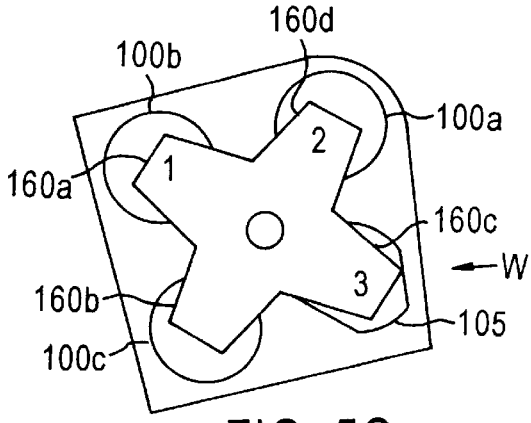
Figure 5D:
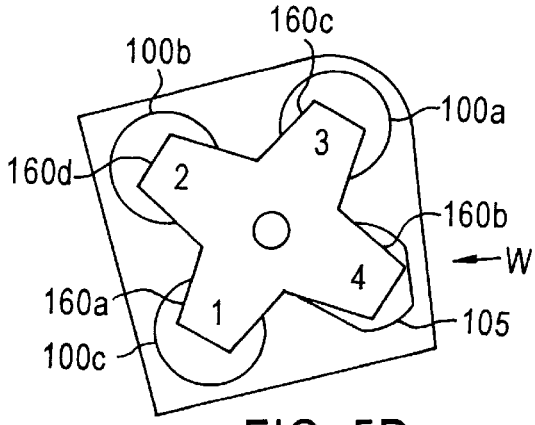
Figure 5E:
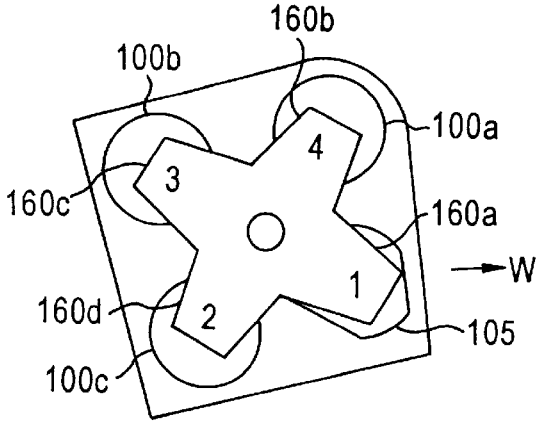
Figure 5F:
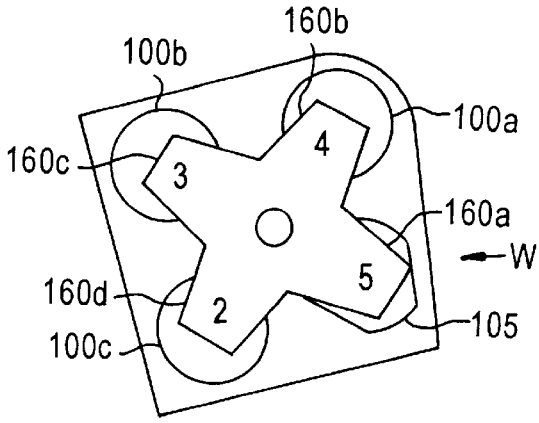

FIGS. 5A–5F show the carousel 150 and its movement with respect to the insertion of a substrate such as a wafer (W) and subsequent movement of carrier head systems 160*a*–160*d*. As shown in FIG. 5A, a first wafer W#1 is loaded from loading apparatus 60 into transfer station 105, where the wafer is washed and then loaded into a carrier head 180, e.g., that of a first carrier head system 160*a*. Carousel 150 is then rotated counter-clockwise on supporting center post 152 so that, as shown in FIG. 5B, first carrier head system 160*a* with wafer W#1 is positioned at the first polishing station 10*a*, which performs a first polish of wafer W#1. While first polishing station 100*a* is polishing wafer W#1, a second wafer W#2 is loaded from loading apparatus 60 to transfer station 105 and from there to a second carrier head system 160*b*, now positioned over transfer station 105. Then carousel 150 is again rotated counter-clockwise by 90 degrees so that, as shown in FIG. 5C, first wafer W#1 is positioned over second polishing station 100*b* and second wafer W#2 is positioned over first polishing station 100*a*. A third carrier head system 160*c* is positioned over transfer station 105, from which it receives a third wafer W#3 from loading system 60. In a preferred embodiment, during the stage shown in FIG. 5C, wafer W#1 at second polishing station 100*b* is polished with a slurry of finer grit than wafer W#1 at the first polishing station 100*a*. In the next stage, as illustrated by FIG. 5D, carousel 150 is again rotated counter-clockwise by 90 degrees so as to position wafer W#1 over third polishing station 100*c*, wafer W#2 over second polishing station 100*b*, and wafer W#3 over first polishing station 100*a*, while a fourth carrier head system 160*d* receives a fourth wafer W#4 from loading apparatus 60. The polishing at third polishing station 100*c* is presumed to be even finer than that of second polishing station 100*b*. After the completion of this stage, carousel 150 is again rotated. However, rather than rotating it counter-clockwise by 90 degrees, carousel 150 is rotated clockwise by 270 degrees. By avoiding continuous rotation in one direction, carousel 150 may use simple flexible fluid and electrical connections rather than complex rotary couplings. The rotation, as shown in FIG. 5E, places wafer W#4 over transfer station 105, wafer W#2 over third polishing station 100*c*, wafer W#3 over second polishing station 100*b*, and wafer W#4 over first polishing station 100*a*. While wafers W#1–W#3 are being polished, wafer W#1 is washed at transfer station 105 and returned from carrier head system 160*a* to loading apparatus 60. Finally, as illustrated by FIG. 5F, a fifth wafer W#5 is loaded into first carrier head system 160*a*. After this stage, the process is repeated.

Figure 6:
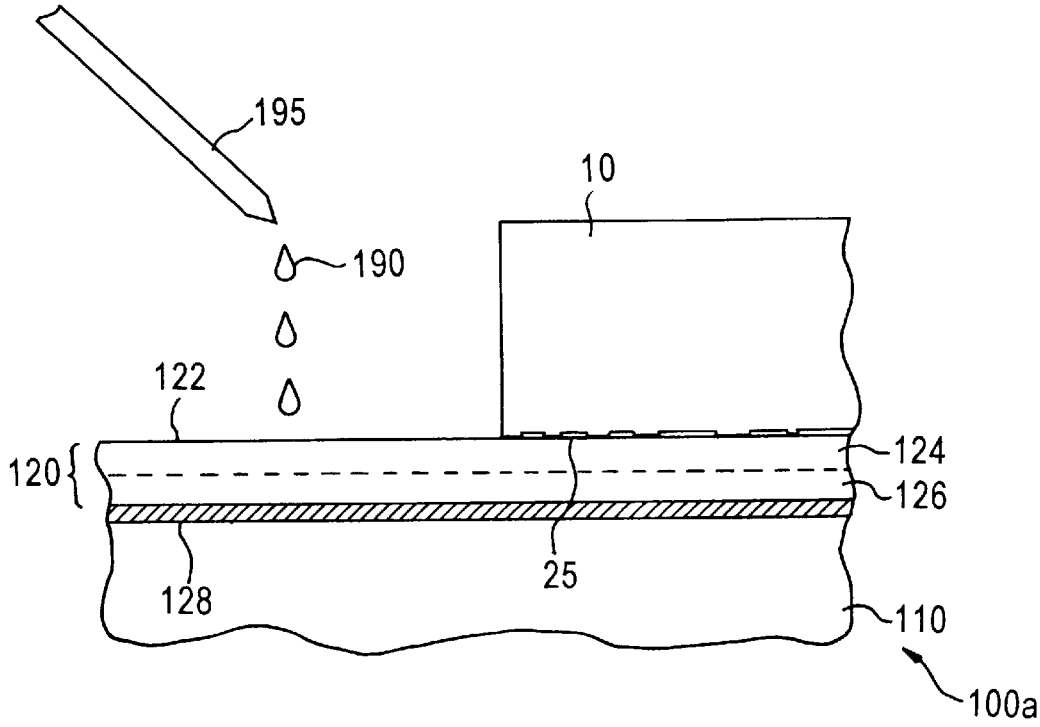
FIG. 6 is a schematic side view of a polishing pad.

As shown in FIG. 6, a carrier head system, such as system 160*a*, lowers substrate 10 to engage a polishing station, such as polishing station 100*a*. As noted, each polishing station includes a rigid platen 110 supporting a polishing pad 120. If substrate 10 is an eight-inch (200 mm) diameter disk, then platen 110 and polishing pad 120 will be about twenty inches in diameter. Platen 110 is preferably a rotatable aluminum or stainless steel plate connected by stainless steel platen drive shaft (not shown) to a platen drive motor (not shown). For most polishing processes, the drive motor rotates platen 120 at thirty to two-hundred revolutions per minute, although lower or higher rotational speeds may be used.

Polishing pad 120 is a hard composite material with a roughened surface 122. Polishing pad 120 may have a fifty mil thick hard upper layer 124 and a fifty mil thick softer lower layer 126. Upper layer 124 is preferably a material composed of polyurethane mixed with other fillers. Lower layer 126 is preferably a material composed of compressed felt fibers leached with urethane. A common two-layer polishing pad, with the upper layer composed of IC-1000 and the lower layer composed of SUBA-4, is available from Rodel, Inc., located in Newark, Del. (IC-1000 and SUBA-4 are product names of Rodel, Inc.). In one embodiment, polishing pad 120 is attached to platen 110 by a pressure-sensitive adhesive layer 128.

Each carrier head system includes a rotatable carrier head. The carrier head holds substrate 10 with the top surface 22 pressed face down against outer surface 122 of polishing pad 120. For the main polishing step, usually performed at station 100*a*, carrier head 180 applies a force of approximately four to ten pounds per square inch (psi) to substrate 10. At subsequent stations, carried head 180 may apply more or less force. For example, for a final polishing step, usually performed at station 100*c*, carrier head 180 applies about three psi. Carrier drive motor 186 (see FIG. 4) rotates carrier head 180 at about thirty to two-hundred revolutions per minute. In a preferred embodiment, platen 110 and carrier head 180 rotate at substantially the same rate.

A slurry 190 containing a reactive agent (e.g., deionized water for oxide polishing), abrasive particles (e.g., silicon dioxide for oxide polishing) and a chemically reactive catalyzer (e.g., potassium hydroxide for oxide polishing), is supplied to the surface of polishing pad 120 by a slurry supply tube 195. Sufficient slurry is provided to cover and wet the entire polishing pad 120.

Chemical-mechanical polishing is a fairly complex process, and differs from simple wet sanding. In a polishing process the reactive agent in slurry 190 reacts with the surface 22 of top layer 20, which may be a conductive, semiconductive, or insulative layer, and with the abrasive particles to form reactive sites. The interaction of the polishing pad, abrasive particles, and reactive agent with the substrate results in polishing.

As mentioned above, the surface of polishing pad 120 becomes "glazed" during the chemical mechanical polishing process. This glazing is primarily caused by pressure and heat applied to the portion of the pad beneath the carrier head. The heat (about 70° C. for 1C-1000) causes the polishing pad to lose its rigidity and flow so that, under pressure, the peaks flatten out and the depressions fill up. A glazed polishing pad has a lower coefficient of friction, and thus a substantially lower polishing rate, than a "fresh" or un-glazed pad. As the polishing rate drops, the time required to polish a substrate increases, and the throughput of substrates through the polishing apparatus falls. In addition, because the polishing pad becomes slightly more glazed after each successive polishing operation, each successive substrate may be polished to a slightly different extent. Therefore, the polishing pad must be periodically conditioned to provide a consistently rough pad surface.

Conditioning deforms the surface of the polishing pad so that it is no longer planar. The conditioning process physically abrades surface 122 of polishing pad 120 to restore its roughness (see FIG. 7). This abrasion "wears" the pad; i.e., it removes material from the surface of the polishing pad. The wear on the polishing pad is often non-uniform. This is because conditioning apparatus 130 (see FIG. 3) may remove more material from polishing pad 120 in some regions than in others.

The non-uniform thickness of the pad affects the substrate polishing rate. When surface 22 of substrate 10 (see FIG. 6) is pushed against surface 122 of polishing pad 120, the thinner areas of the polishing pad are compressed less, and therefore exert less pressure on substrate 10. Consequently, the thinner areas of the polishing pad will polish a substrate at a slower rate than the thicker areas. Therefore, the non-uniform thickness of a polishing pad may generate a non-uniform substrate outer layer.

An unused polishing pad usually has a flat surface. However, as shown schematically by FIG. 7, a used polishing pad 120 has a thickness 'T' that varies across the diameter "d" of the polishing pad. A polishing pad typically wears more in a ring area 121 than at the center 123 or edge 125 of the polishing pad. The radius of ring 121 is about half the radius "R" of the polishing pad.

Conditioning apparatus 130 eventually wears away polishing pad 120 until it is too thin to effectively polish. However, the polishing pad is usually discarded, due to non-uniformities, long before it is worn away. A typical polishing pad has a lifetime of about three-hundred and fifty wafers, assuming the pad is conditioned after each wafer is processed.

Figure 7:
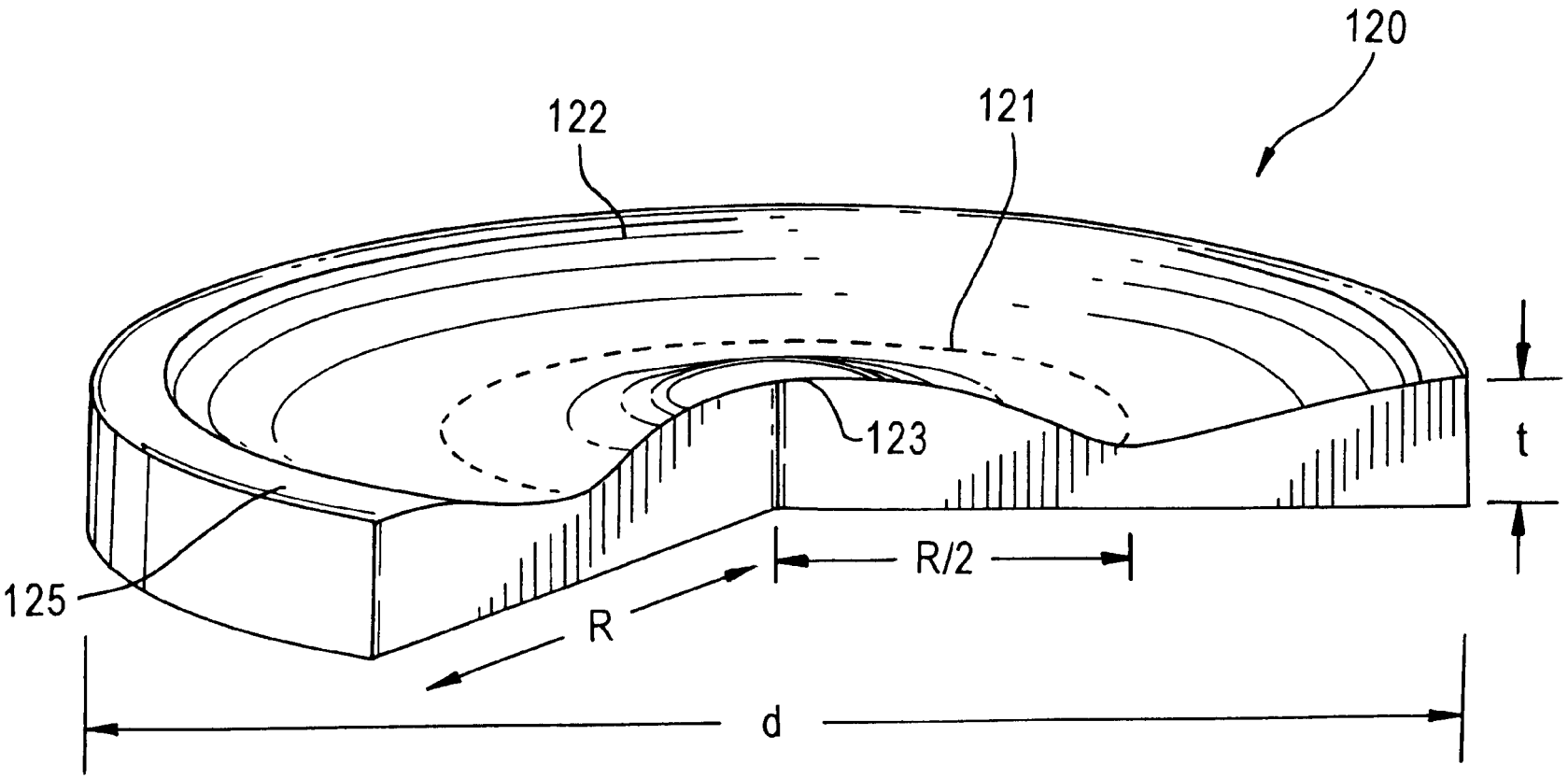
FIG. 7 is a schematic perspective view, with a partial cross-section, of a worn polishing pad.

Because the polishing pad rotates, the conditioning and polishing processes tend to create a radially symmetric wear pattern, as shown in FIG. 7. Since the thickness of the pad is radially symmetric, the operator of a polishing apparatus may evaluate a conditioning process by measuring the pad profile, which is the pad thickness along a diameter. The operator can measure the profile after a number n, e.g., one to twenty, conditioning operations to determine which parts of the pad have degraded the most and whether the wear rate has changed. In prior art methods, an operator tries to find the "best" conditioning process, i.e., the conditioning process that creates the least non-uniformity in pad thickness, by comparing the pad profiles of polishing pads subjected to different conditioning processes.

In addition, an operator can compensate for non-planarity or non-uniformity in the polishing pad by appropriately selecting polishing processing parameters, such as the pressure applied to the substrate, the polishing pad rotation rate, the substrate rotation rate, and the dwell time, which is the duration that a substrate remains at a specific pad location. For example, by selectively sweeping a substrate over both thick and thin regions of the pad, a substrate outer layer may be substantially evenly polished. Alternately, an operator always has the option of simply discarding the polishing pad if the variation in thickness across its surface 122 exceeds some predetermined value.

Although it is possible for an operator to evaluate a conditioning process by measuring the pad profile, as described above, the present invention provides an automatic measuring process and closed loop control of the pad conditioning process. This increases the throughput from the wafers through the chemical-mechanical polishing process, and reduces the need for human intervention and tweaking of the conditioning process.

Figure 8:
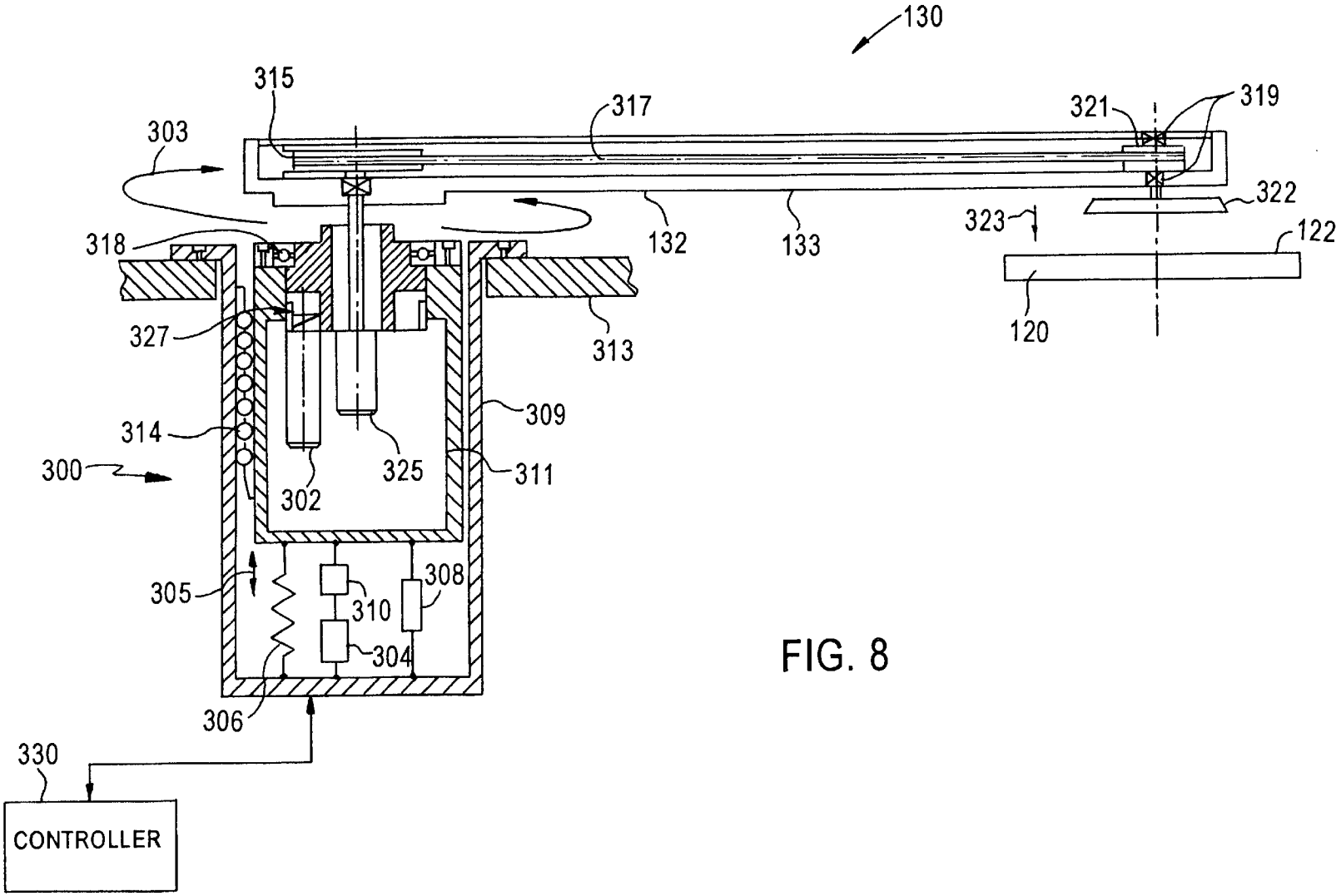
FIG. 8 is a schematic side view of a conditioning apparatus constructed in accordance with embodiments of the present invention.

FIG. 8 is a schematic side view of a conditioning apparatus 130 constructed in accordance with embodiments of the present invention. One of the significant advantages of this conditioning apparatus 130 is provided by the location of the sensors that sense the wear condition of the polishing pad and the down force pressure exerted on the polishing pad within the arm support that is remote from the polishing pad. Hence, the conditioning head does not need to carry these sensors. Also, the apparatus for moving the conditioning head vertically against the polishing pad is also located remotely from the polishing pad. These features enable the conditioning head to be relatively simple in design and avoid movements that require complex design mechanisms to achieve the movements and operate robustly in the harsh environment of a chemical-mechanical polishing slurry. For example, in conventional conditioning heads, in which the disk carrier may move vertically up and down, grit from the slurry created during the polishing of a wafer or the conditioning of a polishing pad may enter and lodge in the conditioning head to prevent proper movement between the mechanical parts of the conditioning head that move the disk carrier vertically or rotationally.

The conditioning apparatus 130 of the present invention includes an arm support 300 that is located remotely from the polishing pad 324. For example, the arm support 300 may be attached to the table top 83 of the machine base 82. However, this connection is exemplary only as the arm support 300 may be affixed to another stationary object. The connection of the arm support 300 to the table top 83 is depicted in FIGS. 3 and 4.

The arm support 300 rotatably and vertically supports arm 132 on which pad conditioning disk 322 is mounted. The arm support 300 includes an arm rotation motor 302 that rotates the arm 132 in the direction indicated by arrows 303. By rotating the arm 132, the pad conditioning disk 322 may be moved to any radial location on the polishing pad 120. Since polishing pad 120 rotates while being conditioned, it is only necessary for the arm 132 to be swung in an amount equal to the radius of the polishing pad 120.

The arm support 300 also includes an outer housing 309 that is secured to a base plate 313. The arm 132 is mounted rotatably within an inner housing 311. Arm rotation bearings 318 and a gear reduction 327 that is coupled to the arm rotation motor 302 are provided. The arm support 300 also includes a vertical actuator 304 that moves the inner housing 311 relative to the outer housing 313 in a vertical direction (i.e. normal to the plane of the polishing pad 120). This direction is depicted in FIG. 8 by arrow 305. The inner housing 311 is guided within the outer housing 309 by bearings 314 under the influence of the vertical actuator 304.

The pad conditioning disk 322 is rotatably driven by a pad conditioner disk motor 325 carried by the inner housing 311. The rotational energy for the disk 322 is transmitted from the motor 325 via a drive pulley 315, drive belt 317, and driven pulley 321. Support bearings 319 are provided for the driven pulley 321.

It is desirable to precisely determine the down force provided on the polishing pad 120. In order to do so, however, it is necessary to ensure that there is a zero down force position in which the pad conditioning disk 322 is just touching the polishing surface 122 of the polishing pad 120. After determining this zero position, changes in the down force may be accurately determined. In order to provide this base line zeroing out of the down force, a counter balance spring 306 is provided in the arm support 300. The counter balance spring 306 biases the inner housing 311 and the arm 132 upwardly and counter balances the weight of the arm 132. When the pad conditioning disk 322 is placed against the polishing surface 122 the polishing pad 120 and the counter balance spring 306 is adjusted so that there is exactly zero down force, accurate determinations of the down force applied may be subsequently obtained. In order to determine the vertical position of the arm 132, and therefore the wear condition of the polishing pad 120, a displacement sensor 308 is provided within the arm support 300. The displacement sensor 308 may be a linear potentiometer or a linear differential variable transducer, for example.

In order to make measurements of the wear of a polishing pad, the position of the arm is determined when the pad conditioning disk 322 is placed against the platen 110, prior to the placement of the polishing pad 120 on the platen 110. Another measurement is taken once the polishing pad 120 has been placed on the surface of the platen 110. The difference between the two readings taken by the displacement sensor 308 represents the thickness of the polishing pad 120. Further changes in the thickness of the polishing pad 120, caused by wear of the pad 120, will then be readily determinable by further measurements of the height of the arm 132 provided by the displacement sensor 308. By rotating the arm 132, the thickness of the pad at any radial location of the polishing pad 130 is provided.

The down force exerted by the arm 132 through the conditioning head 134 and the conditioning disk 322 is represented graphically by arrow 323 in FIG. 8. The amount of down force exerted by the conditioning disk 322 on the polishing surface of the polishing pad 120 is determined by the load sensor 310 located in the arm support 300. The load sensor 310 may be a conventional load cell. In the exemplary embodiment of FIG. 8, the load sensor 310 is a load cell mounted on a glass cylinder. Use of a glass cylinder with a graphite shaft provides a frictionless movement so that the force sensed by the load sensor 310 will accurately reflect the down force exerted by the arm 132. Effects, such as stiction, may therefore be avoided.

The down force measurements provided by the load sensor 310 and the wear measurements provided by the linear position sensor 308 form inputs to a controller 330, schematically indicated in FIG. 8. The controller 330 may be any type of computer able to produce control signals in response to the feedback provided by the sensors of the arm support 300. Controller 330 produces control signals for the arm rotation motor 302 and the vertical actuator 304. These control signals produced by the controller 330 are in response to the determined wear measurements of the polishing pad 120 and the down force measurements of the conditioning disk 322 against the polishing pad 120. One of the advantages provided by the present invention is that the conditioning of the polishing pad 120 may be changed during the conditioning operation. In conventional conditioning methodologies, the conditioning parameters are changed between conditioning operations, after examination of the polishing pad 120. By providing feedback of the measurements of the wear of the pad 120, and the amount of down force applied against the pad 120, the controller 330 may change the conditioning process on the fly.

As apparent from the depiction of the conditioning apparatus 130 of FIG. 8, all of the sensing apparatus and the vertical movement apparatus and the conditioning apparatus 130 are located within the arm support. Hence, the conditioning head 134 may be made less complex so that a disk carrier does not need to extend in a vertical direction from the conditioning head 134 to vary the amount of down force. In other words, the pad conditioning disk 322 need only rotate within the conditioning head 134. This has the benefit of simplifying the construction of the conditioning head 134 as there is no longer a concern about particles preventing movement of the pad conditioning disk carrier 322 in a vertical direction at the end of the arm 132.

Figure 9:
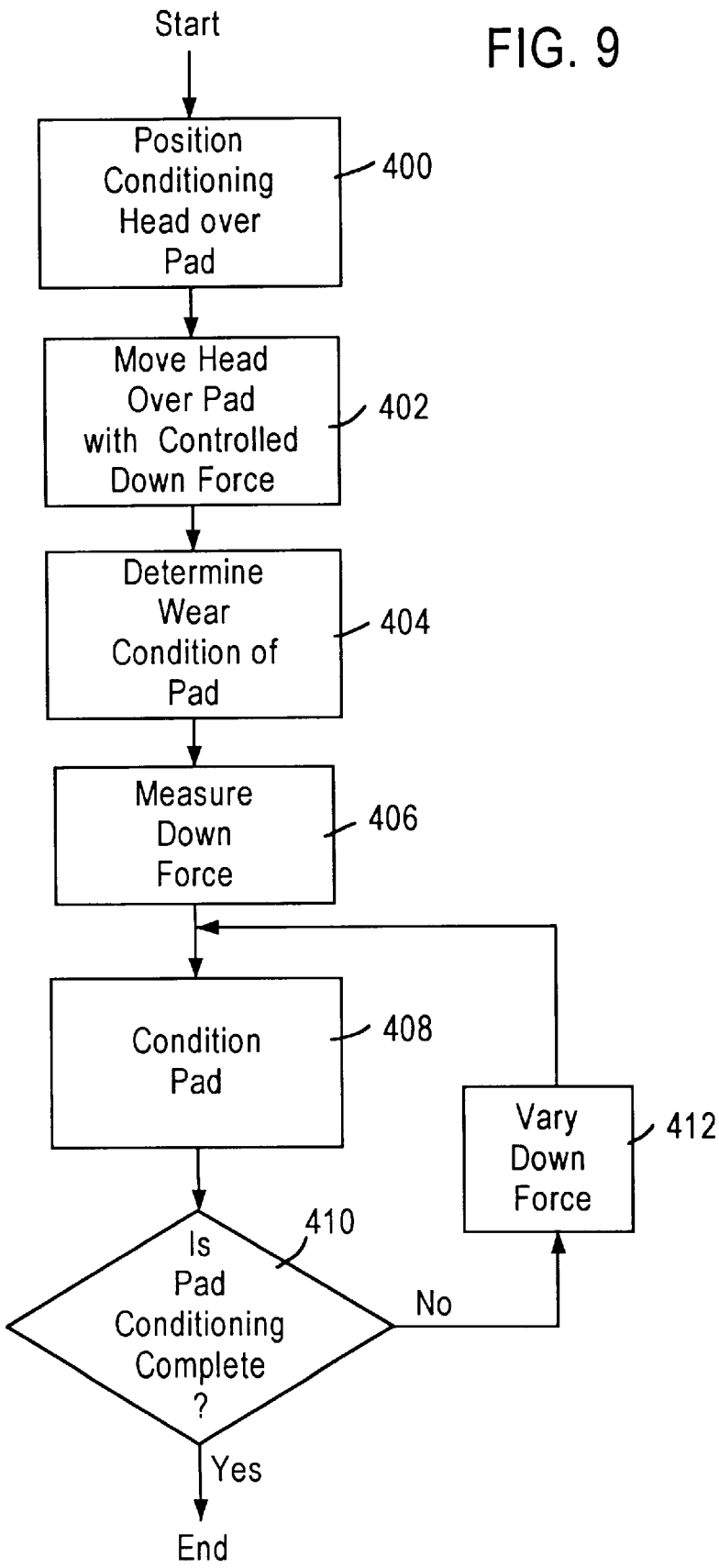
FIG. 9 is a flow chart of an exemplary embodiment of the method of the present invention to control the pad conditioning process.

FIG. 9 is a flow chart of the method of the present invention in accordance with certain embodiments of the invention. Following the polishing of the wafer, the polishing pad conditioning process is started. The conditioning head 134 is positioned over the polishing pad 120, in step 400. This involves the control of the arm rotation motor 302 by the controller 330 to rotate the arm 132 in the rotary direction 303 to the desired radial position over the polishing pad 120.

In step 402, the conditioning head is moved vertically (in a direction normal to the polishing pad 120) to place the conditioning disk 322 against the polishing surface 122 of the polishing pad 120. The conditioning disk 322 exerts a controlled down force against the polishing pad 120. The control of the down force is achieved by the controller 330 operating the vertical actuator 304 to change the vertical position of the arm 132. A precise controlling of the down force is readily achievable since the load sensor 310 provides down force measurements as feedback to the controller 330 as the vertical position of the arm 132 is changed.

The wear condition of the pad 120 is then determined in step 404. As described earlier, this is achieved through measurements of the vertical position of the arm 132 as sensed by the linear position sensor 308. The measurements are provided to the controller 330 as feedback signals. The down force is continuously measured in step 406 and the pad is conditioned in step 408. This involves the conditioning disk 322 interacting with the polishing surface 122 to configure the polishing surface 122 to a desirable shape.

It is then determined in step 410 whether the pad conditioning is completed. This determination may be achieved by measuring the wear condition of the pad 404 through the displacement sensor measurements through the arm 132, which provide indications of the wear condition of the polishing pad 120. If the pad conditioning is not complete, the conditioning continues and if necessary, the down force is varied as a function of the determined wear condition of the polishing pad 120 and the measured down force of the conditioning disk 322 on the polishing pad 120. This is depicted in step 412. The conditioning then continues until the pad conditioning process is complete, as determined in step 410. Once complete, the polishing of wafers may continue. Alternatively, although not explicitly depicted, the conditioning of pad 120 is carried out during the polishing of a wafer.

Figure 10:
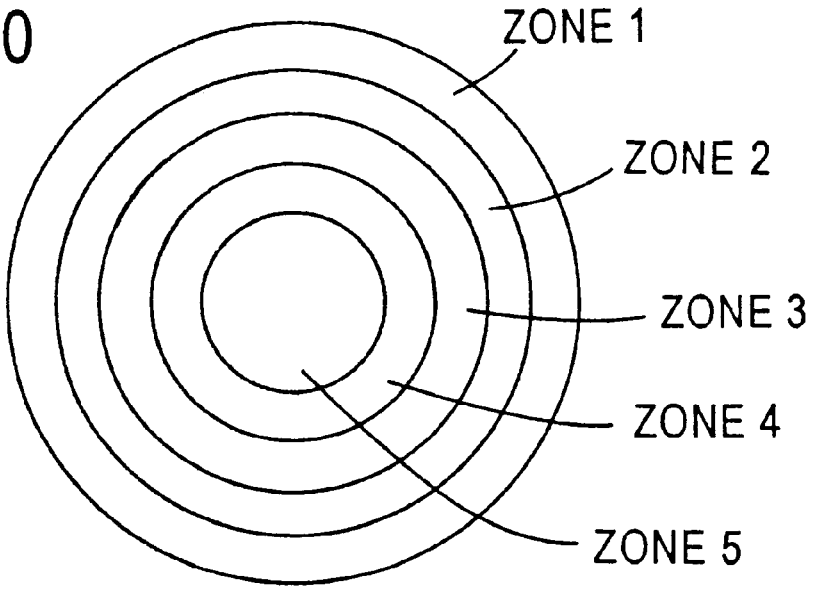
FIG. 10 is a top view of a disk with a depiction of zones of the disk.

A schematic depiction of the top view of a polishing pad 120 is provided in FIG. 10. The polishing pad 120 is logically provided into radial zones. The number of zones may vary, e.g. between 5 and 20 zones. In the illustrated embodiment, the pad 20 is divided into 5 zones. Assume that the pad profiling performed according to the above-described method indicates that the wear of the polishing pad in zone 4 is greater than the wear in zones 1–3 and 5. Also assume that even wear of the polishing pad 120 throughout the five zones is desirable. The relative down force of the conditioning disk 322 on the polishing pad 120 over the different zones may be changed from an equal amount over each zone to an amount such that the down force is increased over zone 4. This would cause zone 4 to be worn by the conditioning apparatus 130 at a faster rate than zones 1–3 and zone 5. The change in the down force has the effect of producing a more evenly worn surface of the polishing pad 120.

Figure 11A:
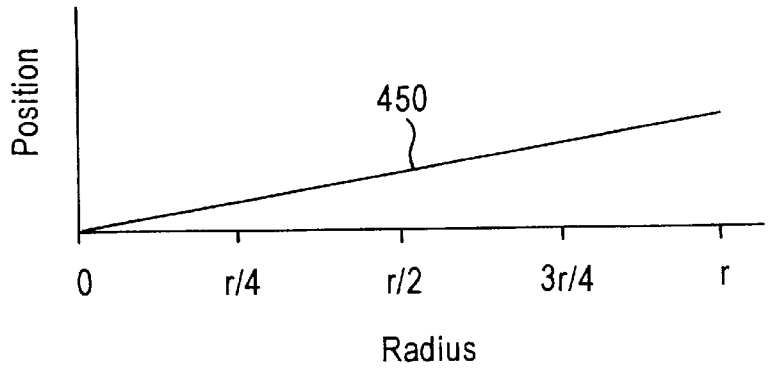
FIGS. 11A–11C are schematic graphics illustrating pad profile measurements.
Figure 11B:
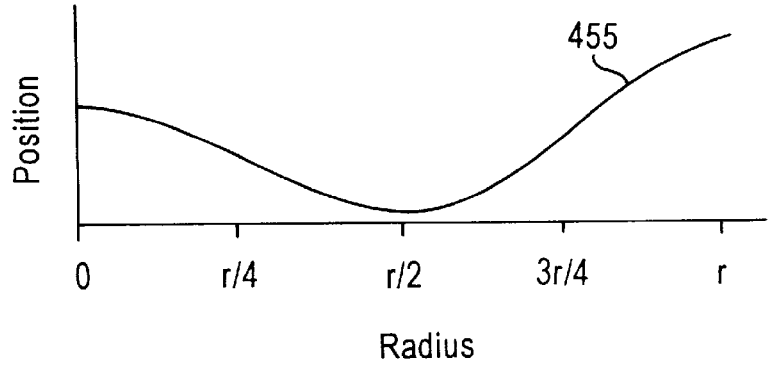
Figure 11C:
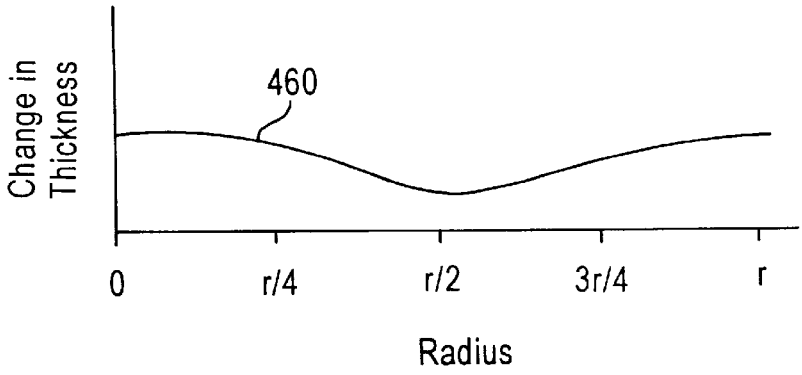

Examples of a base line scan and a measurement scan and a resulting pad profile are illustrated in FIGS. 11A–11B, in which the position along a radial segment of a polishing pad 120 is on the x-axis and the center is on the y-axis. An example of a resulting pad profile is illustrated in FIG. 11C, in which the position along the radial segment is on the x-axis and the change in pad thickness is on the y-axis. As shown in FIG. 11A, if the movement of the pad conditioning disk 322 is not exactly parallel to the surface of the fresh polishing pad 120, then as the pad conditioning disk 322 traverses the polishing pad 120 the displacement sensor 308 will generate a linear sloped response 450 as the arm 132 is moved to maintain a zero down force measurement. As shown in FIG. 11B, if a used polishing pad is on the platen, the displacement sensor 308 will generate a non-linear response 455. To determine the thickness of the pad as a function of distance along the radial segment, response 450 is subtracted from response 455 to create a pad profile 460. In this example, pad profile 460 shows the polishing pad 120 is thinnest in a ring located at about half the radius of the polishing pad (see FIG. 7).

The present invention provides an apparatus and method for improving the conditioning of a polishing pad of a chemical-mechanical polishing apparatus. This is achieved, in part, by locating the sensors and actuators for sensing the wear condition of the pad and the amount of force being applied to the pad in a location that is remote from the polishing pad while providing a precise measurement of the required conditioning parameters, so that the sensors are better protected from the slurry environment. Also, the actuators employed to position the conditioning disk against the polishing pad and control the down force exerted against the polishing pad are located remotely from the conditioning head. This allows a simpler conditioning head to be used and increases the reliability and robustness of the chemical-mechanical polishing apparatus.

Although the present invention has been described and illustrated in detail, it is to be clearly understood that same as by way of illustration and example only and is not to be taken by way of limitation, the scope of the present invention being limited only by the terms of the appended claims.

What is claimed is:

1. An arrangement for conditioning a polishing pad of a chemical-mechanical polishing (CMP) apparatus, comprising:

a pad conditioning head;

a disk carrier on the pad conditioning head, the disk carrier configured to receive and carry a polishing pad conditioning disk;

an arm having first and second distal ends, the pad conditioning head being coupled to the first distal end;

an arm support coupled to the second distal end of the arm, the arm support configured to move the arm to position the conditioning disk carried by the disk carrier against the polishing pad with a controlled amount of down force against the polishing pad;

a down force sensor that measures the down force exerted by the pad conditioning head through the conditioning disk against the polishing pad;

a controller that receives down force measurements from the down force sensor and controls the arm support to controllably vary the down force exerted by the pad conditioning head, wherein the controller is configured to receive the down force measurements and control the arm support during conditioning of the polishing pad; and a polishing pad wear measurement device coupled to the controller to provide the controller with polishing pad wear measurements, wherein the polishing pad wear measurement device includes a displacement sensor that measures changes in the position of the pad conditioning head relative to the polishing pad, wherein the controller is configured to control the arm support to vary the down force as a function of the polishing pad wear measurements and the down force measurements.

2. The arrangement of claim 1, wherein the arm has a major longitudinal axis that is parallel to the plane of the polishing pad, the arm support has a major longitudinal axis that is normal to the plane of the polishing pad, and the pad conditioning head has a major axis that is normal to the plane of the polishing pad.

3. The arrangement of claim 2, wherein the arm support includes a fixed outer housing and an inner housing mounted within the outer housing to be vertically moveable with respect to the outer housing.

4. The arrangement of claim 3, wherein the inner housing includes an arm rotation rotor coupled to the second distal end of the arm to controllably rotate the arm.

5. The arrangement of claim 4, wherein the down force sensor includes a load cell coupled between the inner housing and the outer housing that measures the force of the arm in a direction normal to the plane of the polishing pad.

6. The arrangement of claim 5, where the displacement sensor is coupled between the inner housing and the outer housing and measures displacement of the inner housing to the outer housing to thereby measure changes in the position of the pad conditioning head relative to the polishing pad.

7. A chemical-mechanical polishing apparatus comprising:

a platen for supporting a polishing pad;

a wafer carrier for carrying a wafer and positioning the wafer against the polishing pad to polish the wafer; and a polishing pad conditioning arrangement for conditioning the polishing pad, the conditioning arrangement including:

a pad conditioning head;

a disk carrier on the pad conditioning head, the disk carrier configured to receive and carry a polishing pad conditioning disk;

an arm having first and second distal ends, the pad conditioning head being coupled to the first distal end;

an arm support coupled to the second distal end of the arm, the arm support configured to move the arm to position the polishing pad conditioning disk carried by the disk carrier against the polishing pad with a controlled amount of down force against the polishing pad;

a down force sensor that measures the down force exerted by the pad conditioning head through the conditioning disk against the polishing pad;

a controller that receives down force measurements from the down force sensor and controls the arm support to controllably vary the down force exerted by the pad conditioning head, wherein the controller is configured to receive the down force measurements and control the arm support during conditioning of the polishing pad; and a polishing pad wear measurement device coupled to the controller to provide the controller with polishing pad wear measurements, wherein the polishing pad wear measurement device includes a displacement sensor that measures changes in the position of the pad conditioning head relative to the polishing pad and wherein the controller is configured to control the arm support to vary the down force as a function of the polishing pad wear measurements and the down force measurements.

8. The apparatus of claim 7, wherein the arm has a major longitudinal axis that is parallel to the plane of the polishing pad, the arm support has a major longitudinal axis that is normal to the plane of the polishing pad, and the pad conditioning head has a major axis that is normal to the plane of the polishing pad.

9. The apparatus of claim 8, wherein the arm support includes a fixed outer housing and an inner housing mounted within the outer housing to be vertically moveable with respect to the outer housing.

10. The apparatus of claim 9, wherein the inner housing includes an arm rotation rotor coupled to the second distal end of the arm to controllably rotate the arm.

11. The apparatus of claim 10, wherein the down force sensor includes a load cell coupled between the inner housing and the outer housing that measures the force of the arm in a direction normal to the plane of the polishing pad.

12. The apparatus of claim 11, where the displacement sensor is coupled between the inner housing and the outer housing and measures displacement of the inner housing to the outer housing to thereby measure changes in the position of the pad conditioning head relative to a polishing pad.

13. An arrangement for conditioning a polishing pad of a chemical-mechanical polishing (CMP) apparatus, comprising:

a pad conditioning head;

a disk carrier on the pad conditioning head, the disk carrier configured to receive and carry a polishing pad conditioning disk;

an arm having first and second distal ends, the pad conditioning head being coupled to the first distal end;

an arm support coupled to the second distal end of the arm, the arm support having a rotary actuator to rotate the arm to position the polishing pad conditioning disk carried by the disk carrier over the polishing pad, the arm support having a vertical actuator to move the arm in a direction normal to the polishing pad to position the polishing pad conditioning disk carried by the disk carrier against the polishing pad, wherein the arm support includes a down force measurement sensor that measures the down force exerted by the arm through the disk carrier and the polishing pad conditioning disk against the polishing pad, wherein the arm support further includes a differential position sensor that measures changes in the position of the arm in the normal direction and the differential position sensor is coupled to the controller to provide the controller with position measurements, with changes in the position measurements when the conditioning disk is against the polishing pad indicating an amount of wear of the polishing pad; and a controller that receives down force measurements from the down force measurement sensor as feedback and controls the vertical actuator to provide a controlled down force wherein the controller is further configured to control the vertical actuator to control the down force as a function of the indicated amount of wear and the down force measurements.

* * * * *

UNITED STATES PATENT AND TRADEMARK OFFICE

CERTIFICATE OF CORRECTION

PATENT NO. : 6,517,414 B1 
DATED : February 11, 2003
INVENTOR(S) : Tobin et al.

It is certified that error appears in the above-identified patent and that said Letters Patent is hereby corrected as shown below:

Column 5,
Line 25, please change “sub-halfinicron” to -- sub-micron --.

Signed and Sealed this

Sixteenth Day of September, 2003

JAMES E. ROGAN
*Director of the United States Patent and Trademark Office*